United States Patent [19]

Yabsley et al.

[11] Patent Number: 5,026,442

[45] Date of Patent: Jun. 25, 1991

[54] MELT-IN-FUEL EMULSION EXPLOSIVE COMPOSITION AND METHOD

[75] Inventors: Michael Yabsley, Cheltenham; Waclaw Skinder, Essendon; Ken Mitchell, Cheltenham, all of Australia

[73] Assignee: ICI Australia Operations Proprietary Limited, Melbourne, Australia

[21] Appl. No.: 507,217

[22] Filed: Apr. 11, 1990

[30] Foreign Application Priority Data

Apr. 11, 1989 [AU] Australia ..... 3630

[51] Int. Cl.[5] ..... C06B 45/00

[52] U.S. Cl. ..... 149/2; 149/21; 149/46; 149/60; 149/61; 149/76; 149/83; 149/85; 149/109.6

[58] Field of Search ..... 149/2, 21, 109.6, 46, 149/60, 61, 76, 83, 85

[56] References Cited

U.S. PATENT DOCUMENTS 4,248,644 2/1981 Healy ..... 149/2

4,722,757 2/1988 Cooper et al. ..... 149/2

*Primary Examiner*—Stephen J. Lechert, Jr.

*Attorney, Agent, or Firm*—Cushman, Darby & Cushman

[57] ABSTRACT

This invention provides an explosive composition comprising a blend of a melt-in-fuel emulsion and solid particulate oxygen-releasing salt. Said melt-in-fuel emulsion comprises a discontinuous oxygen-releasing salt phase, a continuous water-immiscible organic fuel phase and an emulsifier component. The oxygen-releasing salt is preferably selected such that the water content is minimized. The explosive composition may additionally comprise a discontinuous gaseous component. The compositions are stable against crystallization and segregation and are blowloadable without significant blowback. The compositions have an added advantage of a propensity to be loaded into upholes without the need for stemming or other plugging arrangements.

41 Claims, No Drawings

MELT-IN-FUEL EMULSION EXPLOSIVE COMPOSITION AND METHOD

The present invention relates to an explosive composition, more particularly to an ammonium nitrate-fuel oil composition comprising a melt-in-fuel emulsion.

Ammonium nitrate-fuel oil compositions, often referred to in the art as ANFOs and hereinafter referred to as such, typically consist of about 94% ammonium nitrate prills coated with an anticaking agent and about 6% absorbed fuel oil. Such compositions provide dry blasting agents. ANFO compositions comprising void-containing material are used in applications in which low density is required, for example, in blow loading upwardly inclined boreholes. ANFO compositions also find application in uses where decreased explosive strength is required, such as perimeter blasting or blasting in unstable areas. ANFO compositions for such uses are often augered or poured into the downholes.

Blends of particulate ammonium nitrate (e.g. ANFO) and water-in-oil emulsion explosives have been used widely in the industry. Typically, water-in-oil emulsions used in such blends have relatively high water contents, often above 15% by weight of the emulsion. For example blends of a water-in-oil emulsion explosive and ammonium nitrate (or ANFO) are described in Australian Patent Application No. 29408/71 (Butterworth) and U.S. Pat. Nos. 3,161,551 (Egly et al), 4,111,727 Clay, 4,357,184 (Binet et al) and 4,615,751 (Smith et al). These blends are, in general, not particularly sensitive to detonation and also tend to degenerate on storage. The problems associated with a lack of sensitivity have been overcome to some extent by the addition of sensitizing explosives with the associated increase in cost. While these blends have well known and useful applications, their acceptance by the explosives and mining industries for use in practical applications where prevailing conditions may lead to the necessity of allowing a charged borehole to sleep for days, or weeks, prior to detonation has been limited due to the loss of explosive properties on storage.

The applicants have now found a composition which provides increased storage stability over blends of the type discussed hereinabove.

Accordingly, we provide an explosive composition comprising a blend of a solid particulate oxygen-releasing salt and a melt-in-fuel emulsion wherein said melt-in-fuel emulsion comprises a discontinuous oxygen-releasing salt phase, a continuous water-immiscible organic fuel phase and an emulsifier component, wherein the explosive composition contains less than 4% water by weight of the melt-in-fuel emulsion.

In the context of the present invention, the term "melt-in-fuel emulsion" refers to an emulsion comprising a discontinuous oxygen-releasing salt phase formed by dispersing a melt of molten oxygen-releasing salt in a water-immiscible organic fuel in the presence of an emulsifier. Once the melt-in-fuel emulsion has been formed the discontinuous oxygen-releasing salt phase may be allowed to cool to form a super-cooled liquid or a solid. Such melt-in-fuel emulsions are described in, for example, Australian Patent Application Number 45718/79.

The water content of explosive compositions of the present invention is less than 4% by weight of the melt-in-fuel emulsion. We have found substantial advantage, as is hereinafter described, by reducing the water content of explosive compositions of the present invention to a minimum. Preferably said water content is less than 2% by weight of the melt-in-fuel emulsion. More preferably, explosive compositions of the present invention are substantially free of water.

Blends of particulate ammonium nitrate (e.g. ANFO) and emulsions which form the prior art and have been hereinabove discussed all comprise substantial amounts of water. The water is generally present in such blends almost entirely in the discontinuous phase of the emulsion.

In the explosive compositions of the present invention particular attention is paid to the water content of the discontinuous oxygen-releasing salt phase of the melt-in-fuel emulsion. The discontinuous oxygen-releasing salt phase of the melt-in-fuel emulsion comprises at least one oxygen-releasing salt. Preferably the discontinuous oxygen-releasing salt phase comprises no added water.

The oxygen-releasing salt for use in the discontinuous phase of the melt-in-fuel emulsion is preferably selected from the group consisting of alkali and alkaline earth metal nitrates, chlorates and perchlorates, ammonium nitrate, ammonium chlorates, ammonium perchlorate and mixtures thereof. The oxygen-releasing salt is preferably selected such that the water content is minimized. Some oxygen-releasing salts contain large amounts of water of crystallization and thus are unsuitable for use in large amounts in compositions of the present invention. For example, calcium nitrate contains substantial water of crystallization, typically of the order of 15% by weight of the calcium nitrate. It is preferred that the use of oxygen-releasing salts with such large waters of crystallization are avoided or at least reduced to very low levels.

It is particularly preferred that the oxygen-releasing salt is ammonium nitrate.

The oxygen-releasing salt for use in the discontinuous phase of the melt-in-fuel emulsion may further comprise a melting point depressant. Suitable melting point depressants for use with ammonium nitrate in the discontinuous phase include inorganic salts such as lithium nitrate, silver nitrate, lead nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetate, and ammonium acetate; glycine; chloracetic acid; glycolic acid; succinic acid; tartaric acid; adipic acid; lower aliphatic amides such as formamide, acetamide and urea; urea nitrate; nitrogenous substances such as nitroguanidine, guanidine nitrate, methylamine, methylamine nitrate, and ethylene diamine dinitrate; and mixtures thereof.

It is particularly preferred that the discontinous phase of the melt-in-fuel emulsion be a eutectic composition. By eutectic composition it is meant that the melting point of the composition is either at the eutectic or in the region of the eutectic of the components of the composition. A preferred eutectic discontinuous phase comprises ammonium nitrate, sodium nitrate and urea wherein the ammonium nitrate is present in an amount of 30–70% by weight of the melt-in-fuel, the sodium nitrate is present in an amount of 5 to 60% by weight of the melt-in-fuel and the urea is present in an amount of 10 to 50% by weight of the melt-in-fuel.

Typically, the discontinuous phase of the melt-in-fuel emulsion comprises 60 to 97% by weight of the melt-in-fuel emulsion, and preferably 86 to 95% by weight of the melt-in-fuel emulsion.

The continuous water-immiscible organic fuel phase of the melt-in-fuel emulsion comprises an organic fuel. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnance oil, kerosene, naphtha, waxes, (e.g. microcrystalline wax, paraffin wax and slack wax), paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbons, generally referred to as petroleum distillate, such as gasoline, kerosene, fuel oils and paraffin oils. More preferably the organic fuel is paraffin oil.

Typically, the continuous water-immiscible organic fuel phase of the melt-in-fuel emulsion comprises from 3 to 30% by weight of the melt-in-fuel emulsion and preferably 5 to 15% by weight of the melt-in-fuel emulsion.

The melt-in-fuel emulsion comprises an emulsifier component. The emulsifier component may be chosen from the wide range of emulsifying agents known in the art to be suitable for the preparation of emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), condensation products of compounds comprising at least one primary amine and poly[alk(en)yl]succinic acid or anhydride, and mixtures thereof. Among the preferred emulsifying agents are the 2-alkyl-and 2-alkenyl-4,4'-bis(hydroxmethyl)oxazolines, the fatty acid esters of sorbitol, lecithin, copolymers of poly(oxyalkylene)glycols and poly(12-hydroxystearic acid), condensation products of compounds comprising at least one primary amine and poly[alk(en)yl]succinic acid or anhydride, and mixtures thereof.

More preferably the emulsifier component comprises a condensation product of a compound comprising at least one primary amine and a poly[alk(en)yl]succinic acid or anhydride. Australian Patent Application No. 40006/85 (Cooper and Baker) discloses emulsion explosive compositions in which the emulsifier is a condensation product of a poly[alk(en)yl]succinic anhydride and an amine such as ethylene diamine, diethylene triamine and ethanolamine. Further examples of preferred condensation products may be found in our co-pending Australian Patent Applications, Nos. 29933/89 and 29932/89.

Typically, the emulsifier component of the melt-in-fuel emulsion comprises up to 5% by weight of the melt-in-fuel emulsion composition. Higher proportions of the emulsifier component may be used and may serve as a supplemental fuel for the composition but in general it is not necessary to add more than 5% by weight of emulsifier component to achieve the desired effect. Stable emulsions can be formed using relatively low levels of emulsifier component and for reasons of economy it is preferable to keep to amount of emulsifier component used to the minimum required to have the desired effect. The preferred level of emulsifier component used is in the range from 0.4 to 3.0% by weight of the melt-in-fuel emulsion.

If desired other, optional fuel materials, hereinafter referred to as secondary fuels, may be incorporated into the melt-in-fuel emulsions. Examples of such secondary fuels include finely divided solids. Examples of solid secondary fuels include finely divided materials such as: sulfur; aluminium; carbonaceous materials such as gilsonite, comminuted coke or charcoal, carbon black, resin acids such as abietic acid, sugars such as glucose or dextrose and other vegetable products such as starch, nut meal, grain meal and wood pulp; and mixtures thereof.

Typically, the optional secondary fuel component of the melt-in-fuel emulsion comprises from 0 to 30% by weight of the melt-in-fuel emulsion.

In the explosive composition of the invention it is preferred that the melt-in-fuel emulsion is present in the range of 3 to 40% by weight, more preferably 5 to 30% by weight of the explosive composition. In top loading applications it is preferred that about 60% melt-in-fuel be used.

The solid particulate oxygen-releasing salt for use in an explosive composition according to the invention may be selected from suitable solid particulate oxygen-releasing salts such as alkali and alkaline earth metal nitrates, chlorates and perchlorates, ammonium nitrate, ammonium chlorates, ammonium perchlorate and mixtures thereof. The solid particulate oxygen-releasing salt is selected such that water content is minimized. It is preferred that the particulate oxygen-releasing salt be in granular or prilled form. We have found it preferable to use particulate ammonium nitrate in compositions of the present invention, more preferably the particulate ammonium nitrate is in the form of prilled ammonium nitrate. The ammonium nitrate may be coated with a fuel oil to produce a substance usually referred to as "ANFO". ANFO comprises preferably 2–15% by weight fuel oil, and more preferably 6% by weight fuel oil.

The solid particulate oxygen-releasing salt is preferably present in the range of 60 to 95% by weight, more preferably 70 to 90% by weight of the explosive composition.

The explosive composition is preferably oxygen-balanced. This may be achieved by providing a blend of components which are themselves oxygen balanced or by providing a blend which, while having a nett oxygen balance, comprises components which are not themselves oxygen balanced. This provides a more efficient explosive composition which, when detonated, leaves fewer unreacted components. Additional components may be added to the explosive composition to control the oxygen-balanced of the explosive composition.

The explosive compositions of the present invention may additionally comprise a discontinuous gaseous component. The gaseous component may be used to vary the density of the explosive composition.

The methods of incorporating a gaseous component and the enhanced sensitivity of explosive compositions comprising such gaseous components have been previously reported. The gaseous component may, for example, be incorporated into the composition of the present invention as fine gas bubbles dispersed through the composition, as hollow particles which are often referred to as microballoons or microspheres, as porous particles, or mixtures thereof.

A discontinuous phase of fine gas bubbles may be incorporated into the compositions of the present invention by mechanical agitation, injection or bubbling the gas through the composition, or by chemical generation of the gas in situ.

Suitable chemicals for the in situ generation of gas bubbles include peroxides, such as hydrogen peroxide, nitrites, such as sodium nitrite, nitrosoamines, such a N, N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Catalytic agents such as thiocyanate or thiourea may be used to accelerate the decomposition of a nitrite gassing agent. Suitable small hollow particles include small hollow microspheres of glass or resinous materials, such as phenol-formaldehyde, urea-formaldehyde and copolymers of vinylidene chloride and acrylonitrile. Suitable porous materials include expanded minerals such as perlite, and expanded polymers such as polystyrene.

Preferably, expanded polystyrene is used as the discontinuous gaseous component, preferably present in an amount of from 0.5 to 5% by weight of the explosive composition. When expanded polystyrene is selected as the discontinuous gaseous component it is desirable to select an organic fuel which is not aromatic in nature. Preferably paraffinic oils are used in conjunction with expanded polystyrene.

In a preferred embodiment of the present invention we provide an explosive composition adapted for use in blowloading applications, which explosive composition comprises a blend of a solid particulate ammonium nitrate and a melt-in-fuel emulsion wherein said melt-in-fuel emulsion comprises a discontinuous oxygen-releasing salt phase, a continuous water-immiscible organic fuel phase and an emulsifier component, wherein said explosive composition additionally comprises expanded polystyrene and said continuous water-immiscible organic fuel phase consists essentially of paraffinic oils and wherein the explosive composition contains less than 4% of water by weight of the melt-in-fuel emulsion.

It is particularly preferred in this embodiment that the discontinuous oxygen-releasing salt phase consist of a eutectic composition, preferably a mixture of ammonium nitrate, sodium nitrate and urea.

The solid particulate ammonium nitrate is preferably prilled ammonium nitrate. The prilled ammonium nitrate may be provided with a fuel oil coating (i.e. as an ANFO) which is preferably oxygen balanced or be provided as prilled ammonium nitrate with a melt-in-fuel emulsion which is oil rich.

Explosive compositions of the present invention provide a surprising degree of resistance to caking. Caking of solid particulates is a problem which hinders the acceptance in the explosives industry of blends of emulsions and solid particulate ammonium nitrate. Explosives compositions of the present invention also provide stability of the emulsion component when blended with solid particulates. Such blends generally lead to instability of the emulsion.

Explosives compositions of the present invention have substantially reduced segregation and are thus exceptionally suitable for transport and storage. Such compositions may be prepared well in advance of use, stored, transported, loaded and left to sleep in a borehole for some time prior to detonation without any adverse effect on explosive sensitivity.

A particular advantage enjoyed by explosive compositions adapted for blowloading applications is the suitability to blowloading. Such explosive compositions are free-flowing, with little or no caking, and there is little or no blowback of particles, such as low density discontinuous gaseous components, during blowloading.

An even further advantage enjoyed by explosive compositions specifically formulated for blowloading applications is the propensity of such compositions to be loaded into upholes without the need for stemming or other plugging arrangements as well as dedusting any fine particulate matter such as aluminium flakes.

Explosive compositions of the present invention may be prepared by a number of methods. In accordance with the present invention we provide a process for preparing an explosive composition comprising a blend of solid particulate oxygen-releasing salt and a melt-in-fuel emulsion wherein said melt-in-fuel emulsion comprises a discontinuous oxygen-releasing salt phase, a continuous water-immiscible organic fuel phase and an emulsifier component, wherein the explosive composition contains less than 4% of water by weight of the melt-in-fuel emulsion, which process comprises the steps of:

(a) heating the discontinuous phase components of the melt-in-fuel emulsion to form a melt;
(b) combining the so-formed molten components with a water-immiscible organic fuel and an emulsifier component;
(c) mixing until the emulsion is uniform.
(d) blending into the so-formed melt-in-fuel emulsion a solid particulate oxygen-releasing salt and optionally a void material at a temperature below the melting point of the solid particulate oxygen-releasing salt.

The invention is further illustrated by, but in no way limited to the following examples:

EXAMPLE 1

37.6 g chemically pure ammonium nitrate, 8.0 g sodium nitrate and 34.4 g urea were mixed and heated to a temperature of 50° C. to form a melt. This molten composition was then mixed with 17.56 g of "Telura 618", a paraffinic oil ("Telura" is a registered trade mark) and 2.44 g of the emulsifier component to produce a uniform emulsion. The emulsifier component comprised 66% by weight of the condensation product of "Mobilad C207", a polyisobutylene succinic anhydride ("Mobilad" is a registered trade mark) and ethanolamine in a 1:1 molar ratio, and 34% by weight of a paraffinic oil. This produced a melt-in-fuel emulsion explosive comprising 37.60% w/w ammonium nitrate, 8.00% w/w sodium nitrate, 34.40% w/w urea, 17.56% w/w "Telura 618" and 2.44% w/w of the emulsifier component.

2830 g of this melt-in-fuel emulsion was then mixed with 11.1 kg prilled ammonium nitrate and 248 g particulate polystyrene. This formed an explosive composition comprising 20% w/w melt-in-fuel emulsion explosive, 78.4% w/w prilled ammonium nitrate and 1.65% w/w particulate polystyrene.

This composition was blowloaded into a vertical steel tubes (dimensions as below). The inhole density was 0.55 g/cm$^3$.

There was almost no blowback during loading, and the composition remained in the uphole. The velocity of detonation (VOD) was measured over the last meter giving substantially constant results as follows:

| | Steel tube 2 m long 45 mm ID 56 mm OD | | Steel tube 1.4 m long 39 mm ID 62 mm OD |
|---|---|---|---|
| VOD measured | 2.7 | 2.6 | 2.7 |
| every 100 mm | 2.7 | 2.8 | 2.7 |
| over last | 2.6 | 2.6 | 2.7 |
| 0.8 m | 2.7 | 2.8 | 3.0 |
| (km sec$^{-1}$) | 2.7 | 2.3 | 2.7 |
| | 2.5 | 2.9 | 2.7 |
| | 2.7 | 2.3 | 2.5 |
| | AV. 2.7 | 2.6 | 2.7 |

EXAMPLE 2

A melt-in-fuel emulsion was prepared by mixing 470 parts by weight of Chemically Pure Ammonium Nitrate with 100 parts by weight of Sodium Nitrate and 430 parts by weight of Urea. This mixture was then melted and emulsified into 53.4 parts by weight of Paraffin Oil and 16 parts by weight of emulsifier component (The emulsifier component comprised 66% by weight of the condensation product of "Mobilad C207", a polyisobutylene succinic anhydride ("Mobilad" is a registered trade mark) and ethanolamine in a 1:1 molar ratio, and 34% by weight of a paraffinic oil) to form a melt-in-fuel emulsion with a viscosity of about 10,000 centipoise.

81 parts by weight of the so-formed emulsion was blended with 841 parts by weight of prilled ammonium nitrate, 53 parts by weight of atomized aluminium and 25 parts by weight of diesel oil in a "Coxan" auger blender. The product was packaged in 20 kg sealed plastic bags.

The product was stored for 15 months at 40° C. with no sign of any caking of the product.

COMPARATIVE EXAMPLE A

A water-in-oil emulsion was prepared from the following components

| Component | Parts by weight |
|---|---|
| Chemically Pure Ammonium Nitrate | 631 |
| Sodium Nitrate | 250 |
| Paraffin Oil | 53.4 |
| Emulsifier Component* | 16 |

*The emulsifier component comprised 66% by weight of the condensation product of "Mobilad C207", a polyisobutylene succinic anhydride ("Mobilad" is a registered trade mark) and ethanolamine in a 1:1 molar ratio, and 34% by weight of a paraffinic oil.

81 parts by weight of the water-in-oil emulsion was blended with 841 parts by weight of prilled ammonium nitrate, 53 parts by weight of atomized aluminium and 25 parts by weight of diesel oil in a "Coxan" auger blender. The product was packaged in 20 kg sealed plastic bags.

Within 1 to 2 weeks the product was observed to have caked severely.

EXAMPLE 3

The composition prepared at Example 2 was blowloaded into blast holes of 75 mm internal diameter using an NVE loader. Negligible dusting or segregation of the product occurred during loading.

A number of the blastholes were upholes. In these upholes the product was observed to remain in the upholes without the need for stamping.

EXAMPLE 4

A melt-in-fuel emulsion was prepared as described in Example 2.

24 parts by weight of the melt-in-fuel emulsion was blended with 111 parts by weight of prilled ammonium nitrate, 2.48 parts by weight of expanded polystyrene beads and 3.8 parts by weight of paraffin oil. (The volume of the expanded polystyrene beads was equal to that of the prilled ammonium nitrate.

The so-formed product was blowloaded from a vessel pressurized at 300 KPa via a 20 mm hose into a vertical, 80 mm internal diameter, "PERSPEX" tube uphole. Minimal blowback was observed and the product remained in the tube.

COMPARATIVE EXAMPLE B

A product of similar explosive strength to that prepared at Example 4 was prepared.

111 parts by weight of prilled ammonium nitrate, 2.5 parts by weight of expanded polystyrene beads and 3.8 parts by weight of paraffin oil were mixed in a Coxan auger blender.

The product was blowloaded in the manner described at Example 4 into a 45 mm internal diameter "PERSPEX" tube uphole. Considerable blowback of product was observed.

COMPARATIVE EXAMPLE C

The procedure of Comparative Example B was followed and the product was blowloaded into a 65 mm internal diameter tube. This was unsuccessful as the product fell out of the uphole during loading.

EXAMPLE 5

A melt-in-fuel emulsion was prepared according to Example 2.

30 parts by weight of melt-in-fuel emulsion was blended with 112 parts by weight of prilled ammonium nitrate, 3 parts by weight of paraffin oil and 8.5 parts by weight of expanded polystyrene beads.

The product was poured into a 2 m steel tube with an internal diameter of 40 mm. The product was detonated and the velocity of detonation was measured over the last metre, giving substantially constant results as follows:

| | Steel tube 2 m long 40 mm ID |
|---|---|
| VOD measured | 1.35 |
| every 100 mm | 1.35 |
| over last | 1.37 |
| 0.7 m | 1.32 |
| (km sec$^{-1}$) | 1.28 |
| | 1.31 |
| | AV. 1.33 |

EXAMPLE 6

A melt-in-fuel emulsion was prepared by mixing 470 parts by weight of Chemically Pure Ammonium Nitrate with 100 parts by weight of Sodium Nitrate and 430 parts by weight of Urea. This mixture was then melted and emulsified into 50 parts by weight of Paraffin Oil and 15 parts by weight of emulsifier component (The emulsifier component comprised 66% by weight of the condensation product of "Mobilad C207", a polyisobutylene succinic anhydride ("Mobilad" is a registered trade mark) and ethanolamine in a 1:1 molar ratio, and 34% by weight of a paraffinic oil) to form a melt-in-fuel emulsion.

227 parts by weight of the so-formed emulsion was blended with 728 parts by weight of prilled ammonium nitrate and 45 parts by weight of expanded polystyrene beads. The volume content of the expanded polystyrene beads was three times the volume content of the prilled ammonium nitrate. The density of the product was 0.18 g $cm^{-3}$.

The product was blowloaded into a 50 mm internal chamber steel tube uphole and detonated. The velocity of detonation was 2.76 km $sec^{-1}$.

We claim:

1. An explosive composition comprising a blend of a solid particulate oxygen-releasing salt and a melt-in-fuel emulsion wherein said melt-in-fuel emulsion comprises a discontinuous oxygen-releasing salt phase, a continuous water-immiscible organic fuel phase and an emulsifier component, wherein the explosive composition contains less than 4% water by weight of the melt-in-fuel emulsion.

2. An explosive composition according to claim 1 wherein said water content is less than 2% by weight of the melt-in-fuel emulsion.

3. An explosive composition according to either one of claim 1 and 2 wherein said explosive composition is substantially free of water.

4. An explosive composition according to any one of claims 1 to 3 wherein the discontinuous oxygen-releasing salt phase comprises no added water.

5. An explosive composition according to any one of claims 1 to 4 wherein the oxygen-releasing salt of the discontinuous phase of the melt-in-fuel emulsion is substantially free of water of crystallization.

6. An explosive composition according to any one of claims 1 to 5 wherein oxygen-releasing salt is ammonium nitrate.

7. An explosive composition according to any one of claims 1 to 6 wherein the oxygen-releasing salt for use in the discontinuous phase of the melt-in-fuel emulsion further a melting point depressant.

8. An explosive composition according to any one of claims 1 to 7 wherein said melting point depressant is selected from the group consisting of inorganic salts such as lithium nitrate, silver nitrate, lead nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetate, and ammonium acetate; glycine; chloracetic acid; glycolic acid; succinic acid; tartaric acid; adipic acid; lower aliphatic amides such as formamide, acetamide and urea; urea nitrate; nitrogenous substances such as nitroguanidine, guanidine nitrate, methylamine, methylamine nitrate, and ethylene diamine dinitrate; and mixtures thereof.

9. An explosive composition according to any one of claims 1 to 8 wherein the discontinuous hase of the melt-in-fuel composition is a eutectic composition.

10. An explosive composition according to any one of claims 1 to 9 wherein the eutectic discontinuous phase comprises ammonium nitrate, sodium nitrate and urea wherein the ammonium nitrate is present in an amount of 30–70% by weight of the melt-in-fuel, the sodium nitrate is present in an amount of 5 to 60% by weight of the melt-in-fuel and the urea is present in an amount of 10 to 50% by weight of the melt-in-fuel emulsion.

11. An explosive composition according to any one of claims 1 to 10 wherein the discontinuous phase of the melt-in-fuel emulsion comprises 60 to 97% by weight of the melt-in-fuel emulsion.

12. An explosive composition according to any one of claims 1 to 11 wherein the discontinuous phase of the melt-in-fuel emulsion comprises 86 to 95% by weight of the melt-in-fuel emulsion.

13. An explosive composition according to any one of claims 1 to 12 wherein the continuous water-immiscible organic fuel phase of the melt-in-fuel emulsion comprises an organic fuel selected from the group consisting of aliphatic, alicyclic and aromatic compounds and mixtures thereof which are in the liquid state at the formulation temperature.

14. An explosive composition according to any one of claims 1 to 13 wherein said organic fuel is selected from the group consisting of fuel oil, diesel oil, distillate, furnace oil, kerosene, naphtha, waxes, (e.g. microcrystalline wax, paraffin wax and slack wax), paraffin oils, benzene, toluene, xylenes, asphaltic materials, polymeric oils such as the low molecular weight polymers of olefins, animal oils, fish oils, and other mineral, hydrocarbon or fatty oils, and mixtures thereof.

15. An explosive composition according to any one of claims 1 to 14 wherein said organic fuel is a petroleum distillate.

16. An explosive composition according to any one of claims 1 to 15 wherein said organic fuel is paraffin oil.

17. An explosive composition according to any one of claims 1 to 16 wherein the continuous water-immiscible organic fuel phase of the melt-in-fuel emulsion comprises from 3 to 30% by weight of the melt-in-fuel emulsion.

18. An explosive composition according to any one of claims 1 to 17 wherein the continuous water-immiscible organic fuel phase of the melt-in-fuel emulsion comprises from 5 to 15% by weight of the melt-in-fuel emulsion.

19. An explosive composition according to any one of claims 1 to 18 wherein said emulsifier component is selected from the group consisting of alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amines, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), condensation products of compounds comprising at least one primary amine and poly[alk(en)yl]succinic acid or anhydride, and mixtures thereof.

20. An explosive composition according to any one of claims 1 to 19 wherein said emulsifier component is selected from the group consisting of 2-alkyl— and 2-alkenyl-4,4'-bis(hydroxymethyl)oxazolines, the fatty acid esters of sorbitol, lecithin, copolymers of poly(oxyalkylene)glycols and poly(12-hydroxystearic acid), condensation products of compounds comprising at least one primary amine and poly[alk(en)yl]succinic acid or anhydride, and mixtures thereof.

21. An explosive composition according to any one of claims 1 to 20 wherein the emulsifier component comprises a condensation product of a compound comprising at least one primary amine and a poly[alk(en)yl]succinic acid or anhydride.

22. An explosive composition according to any one of claims 1 to 21 wherein the emulsifier component of the melt-in-fuel emulsion comprises up to 5% by weight of the melt-in-fuel emulsion.

23. An explosive composition according to any one of claims 1 to 22 wherein the emulsifier component of the melt-in-fuel emulsion comprises from 0.4 to 3.0% by weight of the melt-in-fuel emulsion.

24. An explosive composition according to any one of claims 1 to 23 wherein the melt-in-fuel emulsion comprises from 3 to 40% by weight of the explosive composition.

25. An explosive composition according to any one of claims 1 to 25 wherein the melt-in-fuel emulsion comprises from 5 to 30% by weight of the explosive composition.

26. An explosive composition according to any one of claims 1 to 25 wherein the solid particulate oxygen-releasing salt is selected from suitable solid particulate oxygen-releasing salts such as alkali and alkaline earth metal nitrates, chlorates and perchlorates, ammonium nitrate, ammonium chlorates, ammonium perchlorate and mixtures thereof.

27. An explosive composition according to any one of claims 1 to 26 wherein the solid particulate oxygen-releasing salt is ammonium nitrate.

28. An explosive composition according to any one of claims 1 to 27 wherein the solid particulate oxygen-releasing salt is prilled ammonium nitrate.

29. An explosive composition according to any one of claims 1 to 28 wherein the prilled ammonium nitrate is coated with a fuel oil to produce an ANFO.

30. An explosive composition according to any one of claims 1 to 29 wherein said ANFO comprises fuel oil in the range of from 2 to 15% by weight of the ANFO.

31. An explosive composition according to any one of claims 1 to 30 wherein said ANFO comprises 6% fuel oil by weight of the ANFO.

32. An explosive composition according to any one of claims 1 to 31 wherein the solid particulate oxygen-releasing salt is in the range of 60 to 95% by weight of the explosive composition.

33. An explosive composition according to any one of claims 1 to 32 wherein the solid particulate oxygen-releasing salt is in the range of 70 to 90% by weight of the explosive composition.

34. An explosive composition according to any one of claims 1 to 33 wherein the explosive composition is oxygen balanced.

35. An explosive composition according to any one of claims 1 to 34 wherein the explosive composition additionally comprises a discontinuous gaseous component.

36. An explosive composition according to any one of claims 1 to 35 wherein the discontinuous gaseous component is expanded polystyrene.

37. An explosive composition according to any one of claims 1 to 36 wherein the expanded polystyrene is in the range of from 0.5 to 5% by weight of the explosive composition.

38. An explosive composition adapted for use in blowloading applications, which explosive composition comprises a blend of a solid particulate ammonium nitrate and a melt-in-fuel emulsion wherein said melt-in-fuel emulsion comprises a discontinuous oxygen-releasing salt phase, a continuous water-immiscible organic fuel phase and an emulsifier component, wherein said explosive composition additionally comprises expanded polystyrene and said continuous water-immiscible organic fuel phase consists essentially of paraffinic oils and wherein the explosive composition contains less than 4% of water by weight of the melt-in-fuel emulsion.

39. An explosive composition according to claim 38 wherein the discontinuous oxygen-releasing salt phase consist of a eutectic composition.

40. An explosive composition according to either of claims 38 or 39 wherein the solid particulate ammonium nitrate is prilled ammonium nitrate.

41. A process for preparing an explosive composition comprising a blend of solid particulate oxygen-releasing salt and a melt-in-fuel emulsion wherein said melt-in-fuel emulsion comprises a discontinuous oxygen-releasing salt phase, a continuous water-immiscible organic fuel phase and an emulsifier component, wherein the explosive composition contains less than 4% of water by weight of the melt-in-fuel emulsion, which process comprises the steps of:

(a) heating the discontinuous phase components of the melt-in-fuel emulsion to form a melt;
(b) combining the so-formed molten components with a water-immiscible organic fuel and an emulsifier component;
(c) mixing until the emulsion is uniform.
(d) blending into the so-formed melt-in-fuel emulsion a solid particulate oxygen-releasing salt and optionally a void material at a temperature below the melting point of the solid particulate oxygen-releasing salt.

* * * * *